United States Patent [19]

Boyden

[11] 3,930,569

[45] *Jan. 6, 1976

[54] POWER DRIVEN TYPEWRITER WITH FLEXIBLE TYPE HEAD

[75] Inventor: Robert E. Boyden, Temple City, Calif.

[73] Assignee: Thomas O'Reilly, Santa Barbara, Calif.

[ * ] Notice: The portion of the term of this patent subsequent to Dec. 25, 1990, has been disclaimed.

[22] Filed: Dec. 21, 1973

[21] Appl. No.: 427,231

Related U.S. Application Data

[62] Division of Ser. No. 69,542, Sept. 4, 1970, Pat. No. 3,780,845.

[52] U.S. Cl. ..... 197/16; 197/53; 197/71

[51] Int. Cl.[2] ... B41J 23/04; B41J 1/54; B41J 25/24

[58] Field of Search ..... 197/16–18, 197/90, 71, 49, 53, 54

[56] References Cited

UNITED STATES PATENTS

| | | | |
|---|---|---|---|
| 2,193,970 | 3/1940 | Krum et al. | 197/53 |
| 2,879,876 | 3/1959 | Palmer et al. | 197/16 |
| 2,919,002 | 12/1959 | Palmer | 197/16 |
| 2,978,086 | 4/1961 | Hickerson | 197/16 |
| 3,302,765 | 2/1967 | Hickerson et al. | 197/16 |
| 3,313,389 | 4/1967 | Cralle, Jr. | 197/90 X |
| 3,352,398 | 11/1967 | Crutcher III et al. | 197/16 |
| 3,362,517 | 1/1968 | Ryan et al. | 197/18 |
| 3,405,794 | 10/1968 | Means | 197/18 X |
| 3,640,369 | 2/1972 | Rolph | 197/53 X |

*Primary Examiner*—Clifford D. Crowder
*Attorney, Agent, or Firm*—Finnegan, Henderson, Farabow, & Garrett

[57] ABSTRACT

A power driven typewriter comprising a shiftable carrier supporting a rotatable and axially movable flexible type drum having a plurality of circumferentially extending rows of type characters thereon. Type keys, when depressed, each condition one each of two groups of actuators and cause operation of a power driven cyclically operable clutch which drives a power bail to operate the two conditioned actuators, one of which is effective to rotate the type drum from any position it may be in to a new position and the other actuator being effective to raise or lower the type drum from any position it may be in to a new position to thus align a type character corresponding to the key depressed at the printing position. Upon alignment of a selected type character, the type drum is flexed radially to cause an imprint. Means are provided to dampen torsional oscillation, wobble, etc. of the drum prior to imprinting.

19 Claims, 13 Drawing Figures

POWER DRIVEN TYPEWRITER WITH FLEXIBLE TYPE HEAD

This is a division of application Ser. No. 69,542, filed Sept. 4, 1970, now U.S. Pat. No. 3,780,845.

BACKGROUND OF THE INVENTION

This invention relates to typewriters and has particular reference to a power driven typewriter having a single type element such as a type drum including a plurality of circumferential rows of type characters thereon, which drum is movable coordinately under control of different type keys to locate a selected type character at a printing point.

In my co-pending application Ser. No. 773,145, filed on Nov. 4, 1968, I disclosed a typewriter of the above type.

It is the principal object of the present invention to reduce the number of operating parts in a typewriter of the above type.

Another object is to reduce the inertia and momentum of a rotatable and axially movable type drum and entrained mechanism.

Another object is to provide a typewriter having a rotatable and axially movable type drum in which the amount of travel of the drum in response to depression of different type keys is reduced to a minimum.

Another object is to simplify the construction of the type drum and printing means of a typewriter of the above type.

Another object is to provide a type drum which is flexed radially to print and in which means are provided to effect consistent printing impression from all type characters on the drum.

Another object is to dampen any oscillations or vibrations of a movable type drum prior to imprinting.

Another object is to provide a simple and inexpensive device for effecting partial letter spacing of a type drum.

Another object is to provide a simple and infinitely variable device for controlling the printing impression of a type member.

A further object is to provide power driven means for both rotatably and axially moving a type drum from any character printing position thereof to any other position.

BRIEF DESCRIPTION OF THE DRAWINGS

The manner in which the above and other objects of the invention are accomplished will be readily understood on reference to the following specification when read in conjunction with the accompanying drawings, wherein.

DESCRIPTION OF THE PREFERRED EMBODIMENT

Figure 1:
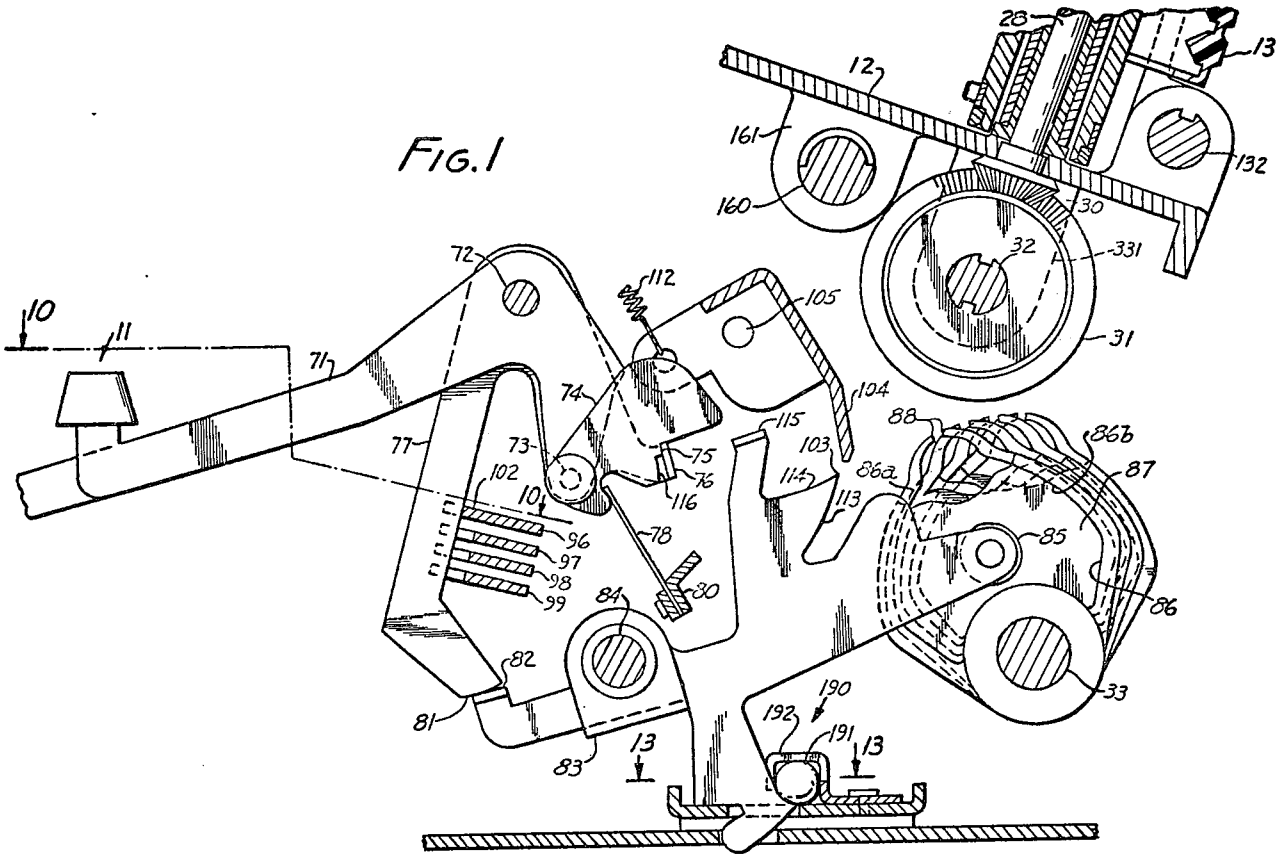
FIG. 1 is a longitudinal sectional view through a typewriter embodying a preferred form of the present invention and illustrating mainly the type drum rotating mechanism.

Referring to the drawings, the typewriter, in general, comprises a keyboard partially indicated at 11 (FIGS. 1 and 10) which includes 44 depressible type keys, a type drum carrier 12 (FIGS. 1, 8 and 9) shiftable transversely of the typewriter, and a type drum 13 carried by the carrier 12, the drum being rotatable and axially movable different amounts by power under control of different ones of the keys to locate any one of a series of 88 type characters at a printing point P on a non-shiftable platen 14. There are four circumferentially extending rows 15,16, 17, and 18 of type characters 20 formed on the drum, each row containing 22 equally spaced characters. A font of 44 lower case type characters extends throughout a zone of 180° on one side of the drum and a font of 44 upper case type characters extends throughout the remaining zone of 180°.

Figure 8:
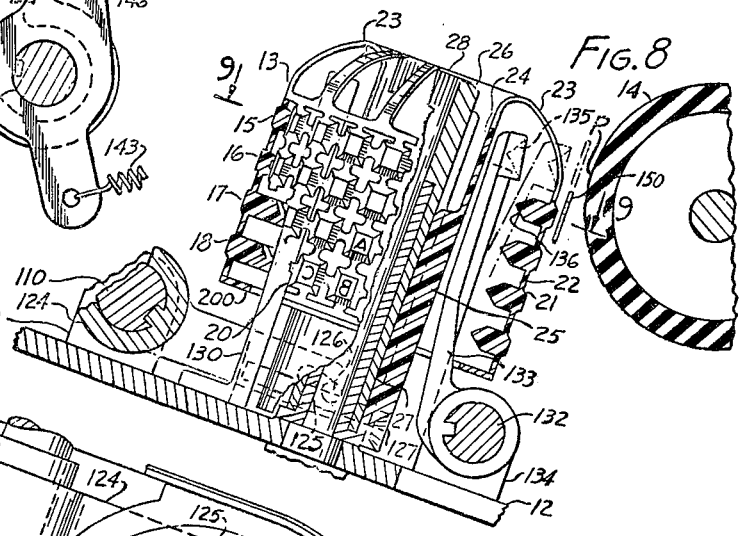
FIG. 8 is a side view, partially in section, illustrating the type drum and type drum carrier.
Figure 9:
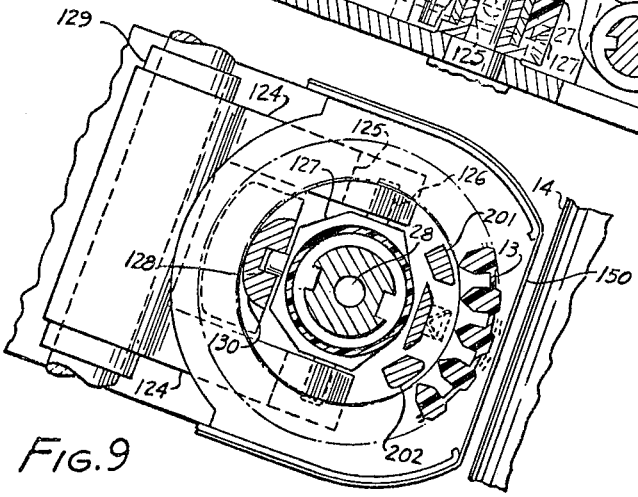
FIG. 9 is a sectional plan view taken substantially along the line 9—9 of FIG. 8.
Figure 10:
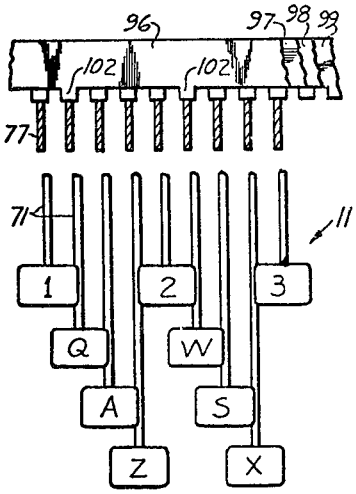
FIG. 10 is a fragmentary plan view of the keyboard and associated mechanism.

As shown in FIGS. 8 and 9, the type drum 13 is preferably formed of one-piece molded plastic. In order to make the drum as light as possible and highly flexible in a radial direction but not in an axial direction, the outer shell thereof is in the form of a cylindrical lattice in which each type character 20 is formed on the outer surface of a radially extending slug 21, such slugs being interconnected by thin flexible bridging connectors 22. The shell terminates at its upper end in flexible spokes 23 which curve inwardly to a thin sleeve portion 24, the latter terminating in a hub 25 which is slidably keyed for axial movement on a tubular drive element 26 rotatably mounted on a hollow bearing post 27 attached to the carrier 12. The drive element 26 is secured to the upper end of a shaft 28 which is journaled in the post 27 and is attached at its lower end to a bevel gear 30 (FIG. 1) meshing with a second bevel gear 31. The latter is slidably keyed on a shaft 32 which is effective both to partly slidably support the carrier 12 and to rotate the type drum to present different type characters to the printing point P. Brackets, one of which is shown at 331, depending from the carrier 12 on opposite sides of the gear 31 maintain the gears 30 and 31 in mesh in all positions of the carrier along the platen.

Figure 3:
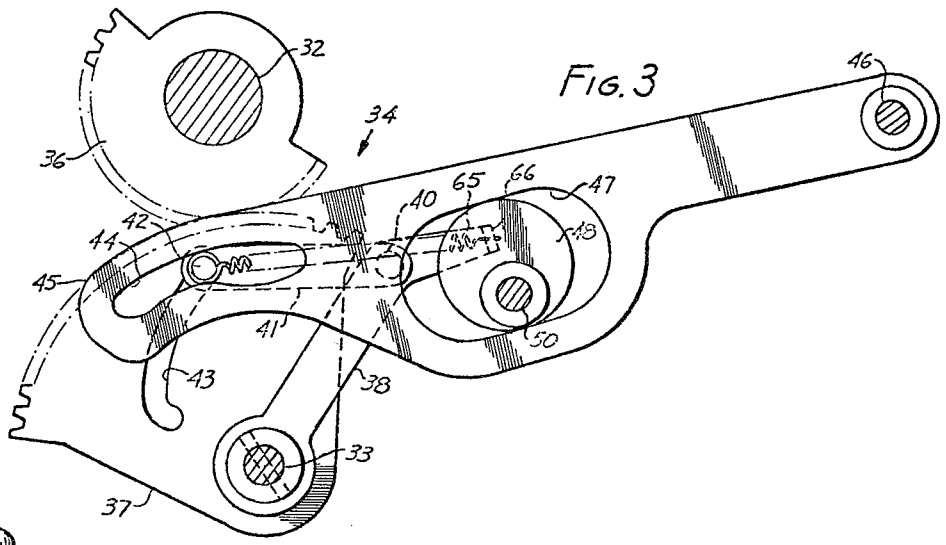
FIG. 3 is a sectional view illustrating the case shift mechanism.
Figure 6:
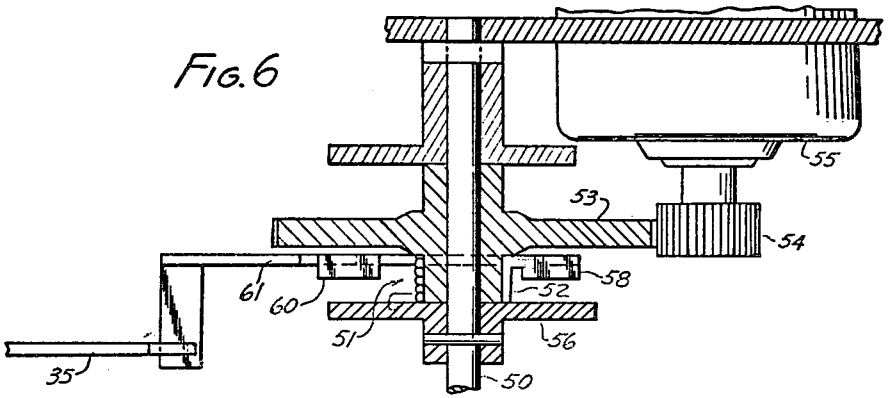
FIG. 6 is a sectional plan view illustrating the case shift clutch and is taken substantially along the line 6—6 of FIG. 5.
Figure 5:
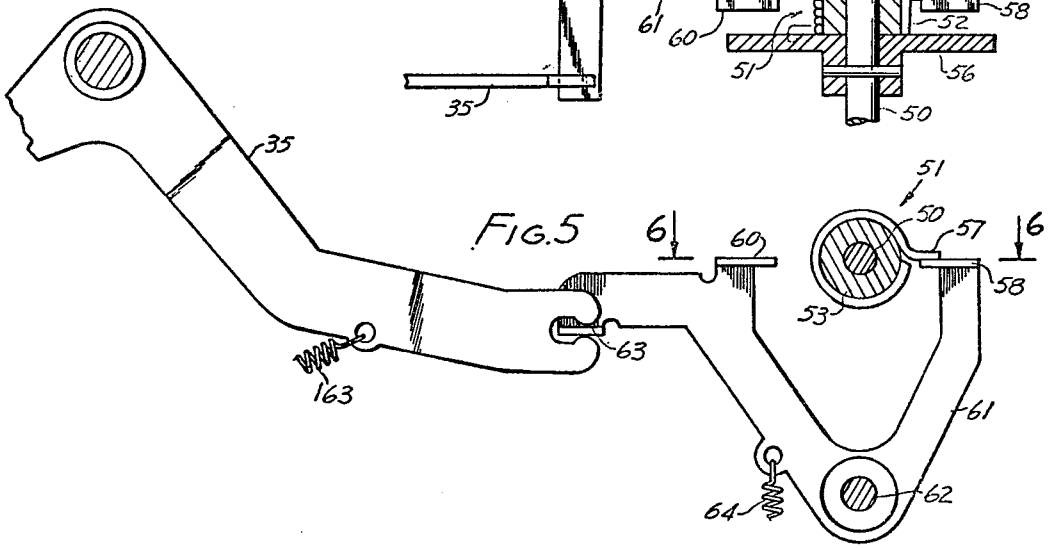
FIG. 5 is a sectional view illustrating the case shift clutch controls.

The shaft 32 is rotatably mounted at its opposite ends in bearings (not shown) carried by the framework of the typewriter and is angularly adjusted to rotate the type drum to different positions by a setting shaft 33 (FIGS. 1 and 3) through a case shift control mechanism generally indicated at 34. The latter is effective upon depression of a case shift key (not shown) carried by a case shift lever 35 (FIGS. 5 and 6) to initially rotate the shaft 32 relative to shaft 33 an amount sufficient to rotate the type drum 180° so as to present the upper case font in printing relation to the platen. Upon release of the case shift key, the type drum is returned 180° so as to present the lower case font in printing relation to the platen.

The case shift control mechanism comprises a gear sector 36 fixed on shaft 32 and meshing with a gear sector 37 rotatably mounted on shaft 33. An arm 38 is fixed on shaft 33 and is pivotally connected at 40 to a link 41 carrying a pin 42 which engages in a curved slot 43 in the sector 37 and also loosely extends in a somewhat curved slot 44 formed in an arm 45 which is pivotally supported at 46. The arm 45 has an elongated slot 47 embracing an eccentric 48 fastened to a shaft 50 (see also FIGS. 5 and 6). The eccentric is normally in its position shown in FIG. 3 to cause the type drum to present the lower case font in printing relation to the platen. However, upon depression of the case shift key, the shaft 50 is rotated 180° by means of a cyclically operable case shift clutch generally indicated at 51 and upon release of the case shift key it is again rotated 180°.

The clutch 51 comprises a helically wound spring 52 surrounding the hub of a gear 53 meshing with the drive pinion 54 of a continuously rotating motor 55. One end of the spring 52 is attached to a disc 56 fastened to the shaft 50 and its opposite end 57 extends radially to engage either of two ears 58 and 60 formed on a clutch control lever 61 which is fulcrummed at 62 and pivotally connected at 63 to the case shift control lever 35.

Normally, when the case shift key is in its raised position, tension springs 163 and 64 hold the clutch control lever 61 in its illustrated position wherein the spring end 57 engages the clutch lever ear 58 and the gear 53 rotates freely within the spring 52 and the eccentric 48 holds the arm 45 in its upper position, permitting an over center tension spring 65, tensioned, between the pin 42 and an ear 66 on the arm 38, to hold the pin at the upper extremity of the slot 43. In this condition, differential rocking of the shaft 33 under control of different type keys, as will appear later, will transmit movement through the arm 38, link 41 and sector 37 to cause a corresponding rocking of the shaft 32 and rotation of the type drum to align a selected lower case type character with the printing point P.

Upon depression of the case shift key, the clutch control lever 61 is rocked clockwise, enabling the spring 52 to grip the hub of gear 53 to rotate the shaft 50 and eccentric 48 180° to lower the arm 45, causing the upper edge of the slot 44 to lower the pin 42 along slot 43 and thus cam the sector 37 clockwise relative to the shaft 33 to rotate the type drum 180°. The over center spring 65 now passes below the pivot 40 causing the pin 42 to engage the lower extremity of slot 43 while permitting rocking movement of the shaft 33 to be transmitted to shaft 32 to align a selected upper case type character with the printing point P.

Describing now the means for selectively positioning the type drum by power under control of the various type keys to present any of the 44 type characters in either font in printing position relative to the platen, each of the type keys is mounted on a respective lever 71 (FIGS. 1 and 10) pivotally supported on a stationary shaft 72 and pivotally supporting an interponent 74 at 73. The latter has a primary shoulder 75 normally engaging an ear 76 on an associated lever 77 also pivoted on the shaft 72.

Each interponent 74 is engaged by a respective leaf spring 78 anchored at 80, which spring urges the interponent clockwise relative to its key lever 71 and thereby also urges the key lever itselff clockwise into its illustrated raised position.

Each lever 77 has a camming surface 81 on the lower edge thereof which engages an ear 82 on an actuator bail 83 pivotally supported on a stationary shaft 84 and carrying a camming roller 85 operable within a respective box cam 86 fixed on the setting shaft 33.

There are 11 actuators 83, one for each group of four type keys, and thus the four levers 77 associated with each such group of keys all engage the same ear 82 of one of the actuators.

The various box cams 86 are similar to each other and are fixed in a helical series about the shaft 33. Each cam comprises converging cam walls **86*a* and 86*b* held in rigid relation to each other by an end wall 87. Such end wall, however, terminates below the relatively thin adjacent tips 88 of the cam walls and thus such tips are relatively flexible. Also, the tips 88 are formed into semi-circular formations into which the respective cam roller 85** may seat.

As will be described later, when a type key is depressed and the actuator 83 associated with the group in which such key lies is rocked counter clockwise under power, its roller 85 will engage one or the other of the cam walls of its cam 86 (depending upon the current position of the type drum) and will thus rotate the shaft 33 until the roller 85 seats against the tips 88, thus rotating the type drum into a position wherein a type character 20 corresponding to the key depressed is vertically aligned with the printing point P. During such action, the actuator 83 will be overdriven slightly in a counter clockwise direction as it reaches the upper extremity of its travel, causing the tips 88 of the cam walls to yield slightly. This not only absorbs some of the shock incurred in abruptly arresting the type drum in its new position but also insures that the camming roller 85 will always properly seat against the tips 88.

Figure 2:
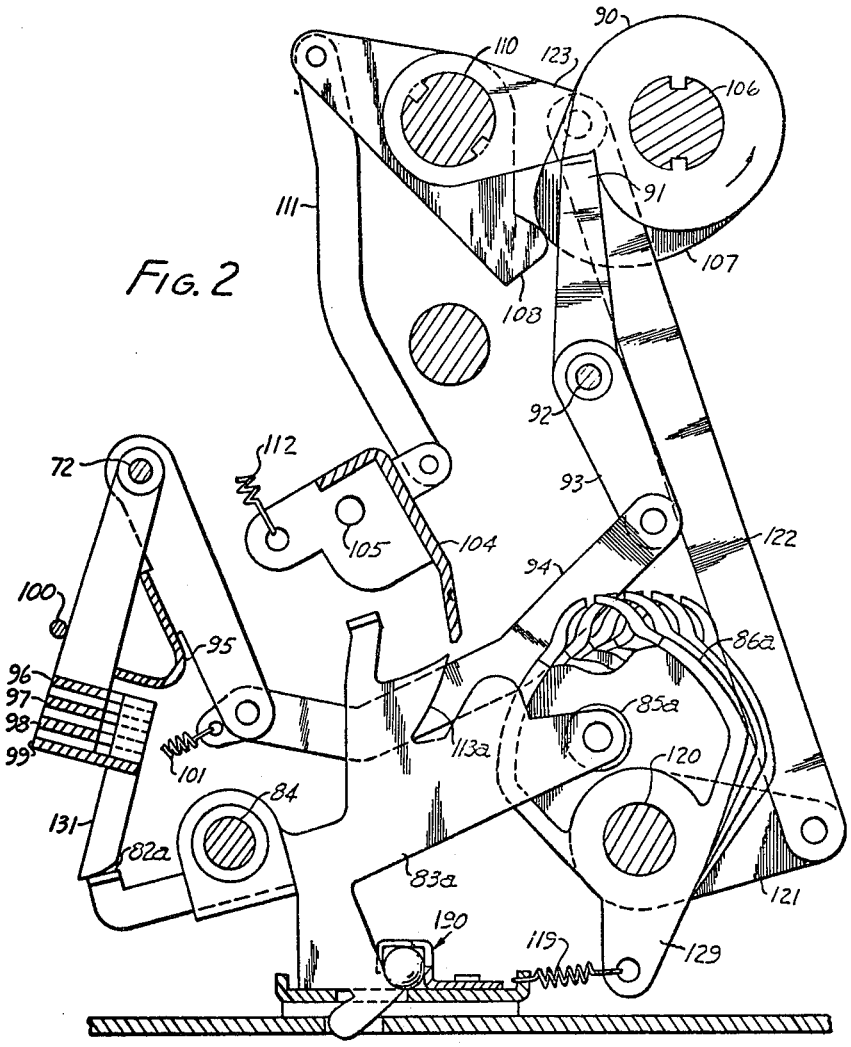
FIG. 2 is a sectional view similar to FIG. 1 but illustrating mainly the type drum raising and lowering mechanism.

As disclosed in my above noted co-pending application, two cyclically operable power clutches are provided, i.e. a space clutch (not shown herein) for character spacing, backspacing, and returning the carrier 12 to an initial position, and an action clutch 90, FIG. 2, for rotating and axially positioning the type drum to locate an appropriate one of the rows of type characters on the type drum at the printing point P, to cause operation of the space clutch, and to effect printing.

The action clutch 90 is of conventional construction and reference may be had to my aforementioned application for a description thereof. The latter is controlled by a clutch dog 91 fixed on a rock shaft 92 to which is fastened an arm 93 connected by a link 94 to an arm of bail 95 pivotally supported by the shaft 72. The bail lies in engagement with the arms of a series of four nested code bails 96 to 99, all independently pivotally supported by the shaft 72 and all extending behind all of the various key operated levers 77 (see also FIGS. 1 and 10). Such code bails are normally held in their illustrated clockwise rocked positions against a stationary member 100 by the bail 95 under the urge of a tension spring 101, thereby normally maintaining the clutch 90 disengaged.

Each of the code bails 96 to 99 has spaced tabs 102 thereon extending in engagement with certain of the levers 77.

Upon depression of a type key its lever 71, through its interponent 74, rocks the associated lever 77, camming the associated actuator 83 slightly counter clockwise to position a sharp shoulder 103 directly in front of a power bail 104 which is pivoted at 105 and extends across all of the actuators 83. At the same time, the actuated lever 77 rocks one of the code bails 96 to 99, depending upon which bail has a tab 102 in engagement with such lever, thereby rocking the clutch control bail 95 to cause engagement of the clutch 90. The latter, which is driven by the motor 55 (FIG. 6) through means not shown, drives a shaft 106, to which is fastened a cam 107, through one complete revolution during each cycle of the clutch.

A cam follower 108, pivotally supported on a shaft 110, is connected by a link 111 to the power bail 104 and is held in engagement with the cam 107 by a relatively strong tension spring 112 connected to the bail.

When the clutch 90 is engaged, the cam 107 will allow the spring 112 to rock the power bail 104 clockwise, causing it to cam along a camming surface 113 on the partly raised actuator 83, thereby forcing the latter counter clockwise to rotate its respective box cam 86, and thus the type drum, into an appropriate new setting.

It should be noted at this time that the type characters 20 on the type drum are so arranged in the different rows 15–18 that the four type characters representing the group of keys associated with the raised actuator will be vertically aligned with the printing point P.

During rocking of the power bail 104 it will sweep over curved surfaces 114 on the remaining actuators 83, preventing such actuators from being raised at this time by their associated keys.

During counter clockwise rocking of an actuator 83 by the power bail 104 an ear 115 thereon will raise the associated interponent 74 a short distance, thereby releasing its shoulder 75 from engagement with the ear 76 of its lever 77, thus permitting disengagement of the clutch 90 at the end of its initial cycle. However, if the corresponding key is held below its normal depressed position, a secondary shoulder 116 on its interponent 74 will now engage the ear 76, thereby holding the clutch engaged throughout two or more successive cycles to cause successive printing by the same type character, as will appear later.

It should be noted that the ear 115 of each actuator spans the interponents 74 of all of the four keys in the associated group.

During the latter part of the cycle of clutch 90, the cam 107 will return the power bail 104 clockwise to its illustrated home position, permitting a new key to be depressed to type the next character.

Figure 13:
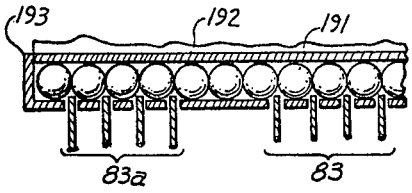
FIG. 13 is a fragmentary sectional view of the actuator interlock and is taken along line 13—13 of FIG. 1.

Means are provided under control of the different type keys to differentially raise or lower the type drum to align different ones of the rows of type characters 15 to 18 with the printing point P concurrently with rotation of the type drum so as to directly align a type character corresponding to a depressed type key with such printing point. For this purpose, a set of four actuators 83*a* (FIGS. 2 and 13) similar to actuators 83, are provided. Such actuators 83*a* are pivotally supported on the shaft 84 and carry cam rollers 85*a* which cooperate with box cams 86*a*, similar to cams 86, and all arranged in a helical series on a setting shaft 120, which is independent of, but co-axial with, the setting shaft 33. Suitable bearings (not shown) support the shaft 120 for rocking movement independently of shaft 33. Attached to shaft 120 is an arm 121 connected by a link 122 to an arm 123 fastened to the shaft 110 (see also FIG. 8) which also partly supports the carrier 12. A yoke 124 is mounted intermediate brackets 129 on the carrier and is slidably keyed on shaft 110. Its arms are slotted at 125 to embrace trunnion pins 126 (see also FIG. 9) carried by a ring 127 seated within a groove in the hub 25 of the type drum. The ring 127 also carries a stud 128 which is guided in a vertical slot formed in an equalizing post 130 fixed to the carrier 12, the purpose of which will be described in detail later. The ring 127 is effective to move the yoke along the shaft 110 as the carrier 12 moves.

For visibility purposes, the type drum is normally held in its lower position shown in FIG. 8 wherein the upper row 15 of type characters lies below the level of the printing point P by a tension spring 119 attached to an arm 129 fastened to the shaft 120.

Each of the code bails 96 to 99 (FIG. 2) carries a camming foot 131 which engages an ear 82*a* of a respective one of the actuators 83*a*. Accordingly, when a type key is depressed, one of the code bails 96 to 99, depending upon the location of the tabs 102, will be actuated to rock the associated actuator 83*a* slightly counter clockwise, placing its camming surface 113*a* in the path of the power bail 104 so that the actuator will be operated in the same manner as described in connection with the actuators 83 to engage its box cam 86*a* and thus, through shaft 110, appropriately position the type drum in an axial direction while it is being rotated.

It should be noted at this time that the tabs 102 and the actuators 83 are preferably arranged in a particular manner depending on the manner in which the type keys are depressed by a typist using the well-known "Touch" typing system wherein each finger is assigned to depress only a certain pattern of keys. For example, one finger might be assigned to depress only the keys I, Q, A and Z (see FIG. 10). Now, since the typist can sequentially depress two keys assigned to two different fingers more rapidly than she can sequentially depress two keys assigned to the same finger, each of the actuators 83 is preferably arranged to be operated by a group of four keys assigned to be depressed by the same finger. This will insure that sufficient time is allowed to sequentially depress two different keys in the same group so that the actuators 83 and 83*a* controlled by one key can be brought back to their initial positions before the actuators controlled by the next key are operated.

Normally, when typing at a relatively slow rate, the spring 119 might be effective to return the type drum on its lower position after each cycle but in the event a new key is depressed prior to such movement by spring 119, the newly operated actuator 83*a* will move the type drum from any axial position it is currently in to a new position.

It will be noted from the above that upon depression of any type key, one of the actuators 83 for causing rotation of the type drum to a new position and one of the actuators 83*a* for causing axial movement of the drum to a new position will be concurrently operated.

In addition to the interlocking feature comprising the power bail 104 for preventing concurrent operation of two or more actuators 83 or two or more actuators 83*a*, a ball type interlock device generally indicated at 190

(FIGS. 1, 2, and 13) is provided to prevent simultaneous depression of two keys in different ones of the above mentioned groups. Such device comprises a series of balls 191 movable along a channel shaped track 192 extending across all of the actuators 83 and 83*a*. End stops, i.e. 193, at opposite ends of the series of balls are spaced to permit only two of the actuators, that is, any one of actuators 83 and any one of the actuators 83*a*, to be swung through their respective strokes at any one time.

Figure 7:
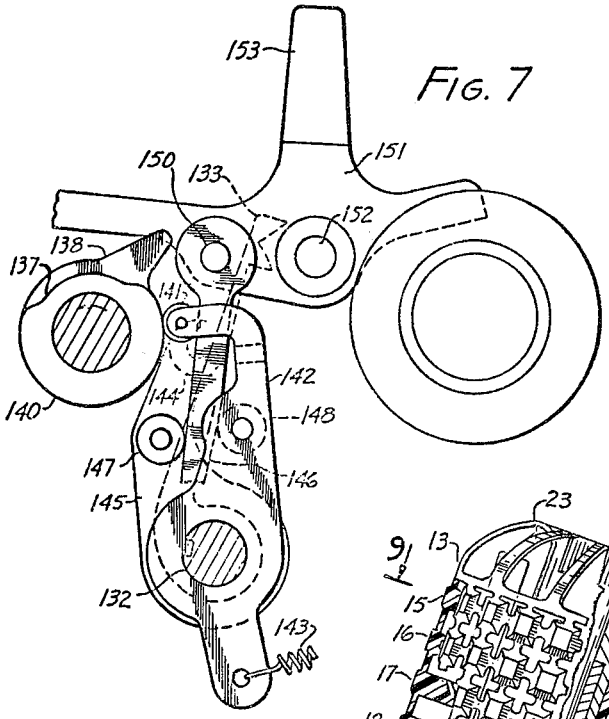
FIG. 7 is a sectional view illustrating the print impression control mechanism.

Print control means are provided under control of the clutch 90 to imprint a selected type character at the printing point P on the platen shortly after the type drum has been properly positioned. For this purpose, a shaft 132 (FIGS. 1, 7, and 8) is rotatably mounted at its ends in bearings carried by the typewriter framework and has slidably keyed thereon a printing impression member in the form of a combined printing hammer and centralizer arm 133 located between two brackets, i.e. 134, on the carrier 12 so as to constrain the arm to move with the carrier. The arm has an indented head portion 135 adapted to engage a pyramidal formation 136 on a generally aligned one of the type slugs 21 to accurately center the aligned type character just prior to printing. The shaft 132 is actuated to cause an imprint through an impression control mechanism shown in FIG. 7. For this purpose, a pair of cams 137 and 138 FIG. 7) are suitably driven by the clutch 90 through one complete revolution during each cycle of the clutch. The cam 137 has a dwell portion 140 which is normally engaged by a roller 141 carried by an arm 142 fixed on the shaft 132 and urged against the dwell portion 140 by a tension spring 143 whereby to normally hold the printing arm 133 in its full line position of FIG. 8.

At a mid-portion of a cycle of clutch 90, the cam 137 allows the spring 143 to rock the shaft 132 counter clockwise, causing the arm 133 to frictionally engage the sleeve portion 24 of the type drum and thereby dampen any torsional oscillations of the type drum occasioned by the abrupt arresting of the same. Shortly thereafter, the cam 138 engages a roller 144 on an arm 145 pivoted on shaft 132, causing the latter to rock the arm 142 through a wedging member 146 which engages between a roller 147 on the arm 145 and a roller 148 on the arm 142. Thus, the shaft 132 is rocked clockwise to swing the printing arm 133 out of engagement with the sleeve portion 24 into engagement with a generally aligned slug 21, precisely aligning the same and causing a radial flexing of the type drum to effect printing through a printing ribbon 150 which is moved opposite the printing point P just prior to the printing operation as is described in my above-noted application.

It will be noted that when the printing arm 133 strikes a slug 21 the type drum will flex radially mainly about a horizontal axis extending across the spokes 23, although the drum may also deform slightly into an out-of-round condition. Since the different rows 15–18 are located different distances from the spokes the printing arm 133 would normally tend to cause a greater printing impression to occur when striking a slug in a lower row, i.e. 18, for example, than when striking a slug in an upper row. Impression control means are provided for equalizing such uneven impression tendency and for this purpose, the post 130 (FIGS. 5 and 9) inclines outward slightly as it extends upwardly away from the carrier and is adapted to be engaged by an inwardly extending annular skirt or flange 200 formed on the bottom of the type drum when the print arm 133 engages a slug 21. Thus, as the drum is raised the space between the post 130 and the skirt 200 becomes smaller to reduce the amount of radial swinging of the drum about the upper end thereof.

Two oscillation dampening posts 201 and 202 are also attached to the carrier 12 and extend upwardly into the typpe drum in close proximity to the inner periphery of the skirt 200. Such posts extend parallel to shaft 28. Any radical oscillations or wobble of the type drum will result in the skirt engaging the posts 201 and 202 and thus damping such oscillations.

Means are provided to adjust the amount of printing impression by the printing arm 133 depending, for example, on the number of carbon copies to be printed or the desired intensity of the print. For this purpose, the wedging member 146 is pivotally connected at 150 to a lever 151 pivotally supported at 152 and provided with a knob 153 which may be manually adjusted to raise and lower the wedging member any desired amount so as to change the angular relationship between the arms 142 and 145. Suitable means (not shown) maintains the lever 151 in any adjusted position.

Figure 4:
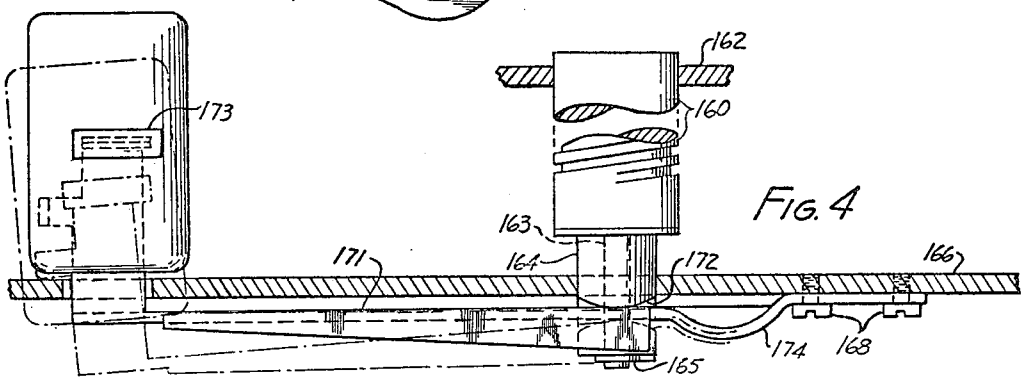
FIG. 4 is a sectional plan view illustrating the partial letter space mechanism.

As described in my forementioned application, the carrier 12 is movable in either direction along the length of the platen 14 by a screw threaded shaft 160 (FIGS. 1 and 4). Such shaft is screw threaded through a bracket 161 depending from the carrier and is rotated by the spring clutch (not shown herein). Such clutch is cyclically operable and is effective to cause the shaft 160 to advance the carrier one letter space during each cycle.

Means are provided herein to effect a partial letter spacing of the carriage. For this purpose, the shaft 160 is both rotatably and endwise movable at one end thereof in a bearing formed in a frame plate 162 (FIG. 4) and at its opposite end it has a reduced bearing section 163 rotatably mounted in a block 164 retained thereon by a suitable clip 165. The block 164 is slidable endwise in a bearing formed in a second frame plate 166.

A spring lever 171 is secured at one end thereof to the plate 166 by screws 168 and engages in a groove 172 in the block 164. The lever 171 terminates at its free end in a knob 173 which may be manually moved to flex the lever 171 about a curved portion 174 thereof and thus move the shaft 160, and consequently the carrier 12, any desired amount which a letter space.

Figure 11:
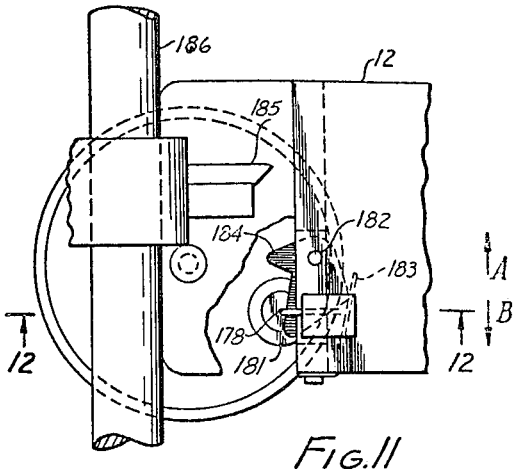
FIG. 11 is a fragmentary plan view illustrating the bell mechanism.
Figure 12:
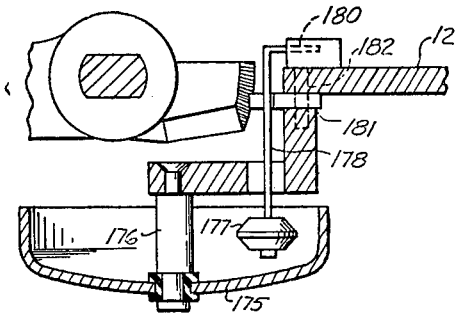
FIG. 12 is a sectional view taken substantially along the line 12—12 of FIG. 11.

Referring to FIGS. 11 and 12, a bell 175 is supported by the carrier 12 to sound an audible alarm when the carrier 12 approaches the righthand end of its travel. The bell is mounted on a post 176 secured to the carrier and is adapted to be struck by a weighted striker 177 formed partly of a spring wire 178 anchored at 180 on the carrier. An actuating lever 181 is pivoted at 182 on the carrier and is normally held in its illustrated position by a leaf spring 183. Lever 181 has a camming nose 184 engagable with an arm 185 adjustable along a tab shaft 186. Normally the arm 185 is stationary. When the carrier 12 moves past the arm 185 in the direction of the arrow A, the arm will rock the lever 181 counter clockwise without deflecting the striker 178. However, when the carrier moves past the arm 185 in the direction of the arrow B the arm will rock the lever 181 clockwise thus deflecting the striker 178 so that when the nose 184 passes the arm the striker 178 will be released and will swing into engagement with the bell.

I claim:

1. A typewriter comprising:

a. a rotatable drive member;

b. a type drum mounted on said drive member for movement therewith, said drum having a plurality of type characters on the outer surface thereof, each of said type characters being movable relative to the remainder of said drum member;

c. selectively operable character selecting elements;

d. means controlled by said selecting elements for effecting alignment of the type character corresponding to the particular selecting element operated with a predetermined printing position;

e. print control means for causing each of said type characters to move from a normal position spaced from said printing position to accurately arrive at said printing position and to consistently apply a predetermined pressure on a record medium, said print control means including i. a printing impression member;

ii. means responsive to operation of each of said selecting elements for causing said impression member to move a predetermined distance along a predetermined path to effect imprint of the type character corresponding to the selecting element operated at said printing position against a record medium, said distance and path being the same for all of said selecting elements, and iii. impression control means restricting movement of said drum toward said printing position, the extent of said restricted movement being a function of the location of the selected type character on said drum, to ensure that each of said type characters applies equal pressure on said record medium.

2. A typewriter as defined in claim 1 wherein said impression member sequentially moves along said path from a first position where said impression member is out of contact with said drum to a second position in contact with said drum.

3. A typewriter as defined in claim 1 wherein said impression member sequentially moves along said path from a. a first position wherein said impression member is out of contact with said drum to permit free movement of said drum during alignment of a selected type character with said printing position;

b. to a second position wherein said impression member contacts a portion of said drum to dampen any torsional oscillation of the drum occasioned by stopping movement of the drum when the selected type character is aligned with said printing position and then c. to a third position wherein said impression member contacts the portion of said drum immediately behind the selected type character to precisely align the type character and cause the type character to contact the record medium.

4. A typewriter as defined in claim 1 wherein:

a. said drum has a cylindrical section;

b. said type characters are aligned in a plurality of equally axially spaced rows, each row including a plurality of equally spaced type characters around the periphery of said cylindrical section; and c. said drum is axially movable by the means controlled by said selecting elements from a first position prior to operation of said selecting elements wherein said type characters are spaced axially below said impression member to a second position effected by operation of each of said selecting elements wherein a type character corresponding to the selecting element operated is axially aligned with said impression member.

5. A typewriter as defined in claim 1 wherein said type drum includes a hub mounted on said drive member and an outer shell spaced from said hub, support means for supporting said shell from said hub, said type characters being mounted on the exterior surface of said shell and said printing impression member being mounted between said hub and said shell.

6. A typewriter as defined in claim 1 wherein said drum includes a plurality of slugs spaced axially and circumferentially about said drum, each slug having a type character on the outer surface thereof, the inner surface of each of said slugs having the same configuration, said impression member including a portion having a configuration complimentary to the slug inner surface configuration to effect a mating interrelationship when said impression member contacts each of said slugs.

7. A typewriter as defined in claim 1 wherein the means responsive to operation of the selecting elements includes a rotary cam and an oscillating cam follower responsive to said cam, the cam follower being operatively connected to said impression member to effect movement of said impression member said predetermined distance.

8. A typewriter comprising:

a. a type drum having a plurality of type characters on the outer surface thereof;

b. a rotatable screw threaded shaft;

c. a carrier mounted in driving engagement with said shaft; said type drum being mounted on said carrier;

d. slectively operable character selecting elements;

e. a printing impression member;

f. a motor continuously operating when said typewriter is in an "on" mode;

g. an action cyclical clutch driven by said motor and responsive to operation of said selecting elements;

h. a space cylical clutch driven by said motor and responsive to operation of said selecting elements;

i. first means for effecting alignment of a type character corresponding to the particular selecting element operated with a predetermined printing position, said first means being actuated by said action clutch;

j. second means driven by said action clutch for causing said impression member to imprint the type character corresponding to said particular selecting element at said printing position against a record medium; and k. third means for actuating said space clutch to effect rotation of said screw threaded shaft by said motor and movement of said carrier relative to said record medium.

9. A typewriter as defined in claim 8 including means for effecting continuous operation of said space clutch throughout at least two successive cycles effecting continuous rotation of said screw threaded shaft and continuous movement of said carrier relative to said record medium.

10. A typewriter as defined in claim 8 wherein:

a. said drum has a cylindrical section;

b. said type characters are aligned in a plurality of equally axially spaced rows, each row including a plurality of equally spaced type characters around the periphery of said cylindrical section; and c. said drum is axially movable by said first means from a first position prior to operation of said selecting elements wherein said type characters are spaced axially below said impression member to a second position effected by operation of each of said selecting elements wherein a type character corresponding to the selected element operated is axially aligned with said impression member.

11. A typewriter as defined in claim 8 wherein said second means includes a cam and a cam follower responsive to said cam, said cam being driven by said action clutch and said cam follower being operatively connected to said impression member to effect consistently accurate movement of said impression member a fixed preselected distance.

12. A typewriter as defined in claim 8 including means for effecting continuous operation of said action clutch throughout at least two successive cycles effecting successive cyclical operation of said space clutch and successive intermittent rotation of said screw threaded shaft.

13. A typewriter as defined in claim 8 including means for effecting operation of said action clutch for a single cycle upon depression of any of said character selecting elements a first distance, said action clutch effecting operation of:

a. said first means to properly position said type drum;

b. said second means to actuate said impression member; and c. the space clutch to move said carrier one letter space, movement of any of said character selecting elements a second distance greater than said first distance effecting continuous operation of said action clutch throughout at least two successive cycles effecting successive operation of said first means, said second means and said space clutch to cause multiple, spaced printing of the type character corresponding to the depressed character selecting element.

14. A typewriter comprising:

a. a type drum having a plurality of type characters on the outer surface thereof;

b. a rotatable screw threaded shaft;

c. a carrier in driving engagement with said shaft; said type drum being mounted on said carrier;

d. a selectively operable character selecting keys;

e. a motor;

f. clutch means driven by said motor in response to operation of said keys;

g. first means actuated by said clutch means for effecting printing of a type character against a record medium and for effecting motor driven rotation of said shaft and movement of said carrier relative to said record medium;

h. a plurality of interponents each of which is operable by depressing at least one of said keys;

i. a clutch control member engagable by said interponents upon depression of said key for causing actuation of said clutch means;

j. a spring engagable with each of said interponents for normally maintaining said interponents in engagement with said control member, the spring also being effective to hold the keys in a raised position.

15. A typewriter as defined in claim 14 wherein each of said interponents has a primary surface and a secondary surface, depression of one of said keys a predetermined amount causing said primary surface to operate said control member to effect actuation of said clutch means for a single cycle and depression of one of said keys beyond said predetermined amount causing said secondary surface to contact and operate said control member to effect actuation of said clutch means for at least two cycles.

16. A typewriter comprising:

a. a type drum having a plurality of type characters on the outer surface thereof;

b. a screw threaded shaft mounted for rotational and axial movement;

c. a carrier in driving engagement with said shaft; said type drum being mounted on said carrier;

d. selectively operable character selecting elements;

e. means for effecting imprint of a selected type character against a record medium;

f. first means for moving said type drum to effect alignment of the type character corresponding to the particular selecting element operated with a predetermined printing position;

g. second means for effecting rotation of said screw threaded shaft and movement of said carrier axially relative to said shaft and record medium, said carrier being moved at least one letter space for each action of said second means;

h. yieldable means for normally preventing axial movement of said shaft; and i. manually operable means for moving said shaft axially relative to said record medium to move said carrier through any part of said letter space.

17. A typewriter comprising:

a. a platen;

b. a type drum having a plurality of spaced rows of type characters on the outer surface thereof;

c. a carrier mounted for longitudinal movement relative to said platen, said type drum being mounted on said carrier;

d. a keyboard having i. a plurality of substantially parallel rows of selectively operable character selecting elements, the number of rows of character selecting elements being equal to the number of rows of type characters and being generally parallel to said platen and ii. a plurality of columns of character selecting elements, said columns being transverse to said rows of selecting elements;

e. a motor;

f. clutch means driven by said motor for moving said carrier relative to said platen for positioning said drum relative to a printing position and for effecting printing of a selected type character; and g. first means including a plurality of actuators responsive to said character selecting elements for actuating said clutch means to effect alignment of a type character corresponding to the particular selecting elements operated with said printing position, the number of actuators being equal to the number of character selecting elements evenly divided by a whole number greater than one and not greater than the number of rows of character selecting elements, each actuator being responsive to at least two keys aligned within the same column.

18. A typewriter as defined in claim 17 wherein the number of actuators is equal to the number of character selecting elements divided by the number of rows of character selecting elements.

19. A typewriter as defined in claim 18 wherein the number of character selecting elements is 88 and the number of actuators is 11.

* * * * *